United States Patent [19]

Wagner

[11] Patent Number: 4,931,034

[45] Date of Patent: Jun. 5, 1990

[54] BAGS MADE FROM THERMOPLASTIC SYNTHETIC RESIN SHEETING HAVING CUTOFF WELD SEAMS AND PROCESS FOR PRODUCING THE BAGS

[75] Inventor: Robert Wagner, Troisdorf-Sieglar, Fed. Rep. of Germany

[73] Assignee: Stiegler GmbH Maschinenfabrik, Rudersberg, Fed. Rep. of Germany

[21] Appl. No.: 228,743

[22] Filed: Aug. 5, 1988

[30] Foreign Application Priority Data

Aug. 5, 1987 [DE] Fed. Rep. of Germany ..... 3725876

[51] Int. Cl.[5] ..... B31B 1/64

[52] U.S. Cl. ..... 493/203; 493/193; 493/194; 493/195; 493/196

[58] Field of Search ..... 493/193, 194, 195, 196, 493/203

[56] References Cited

U.S. PATENT DOCUMENTS

| | | | |
|---|---|---|---|
| 2,401,109 | 5/1946 | Rohdin | 493/195 |
| 4,046,065 | 9/1977 | Plate | 493/203 |
| 4,571,235 | 2/1986 | Benoit | 493/195 |

*Primary Examiner*—Frederick R. Schmidt
*Assistant Examiner*—Jack W. Lavinder
*Attorney, Agent, or Firm*—Antonelli, Terry, Stout & Kraus

[57] ABSTRACT

A process for the production of bags from thermoplastic synthetic resin sheeting with a bottom seam and/or a lateral seam fashioned as a cutoff weld seam obtained by severing tubular film sheets in the bottom zone, wherein there is produced by heat contact welding, at a station upstream of a transverse seam cutoff welding of the bottom seam or lateral seam, a wide flush weld seam over the entire width of the tubular film sheet and/or of the bag bottom to be produced, and subsequently the transverse cutoff weld seam is formed over the flush weld seam, extending within the flush weld seam.

18 Claims, 4 Drawing Sheets

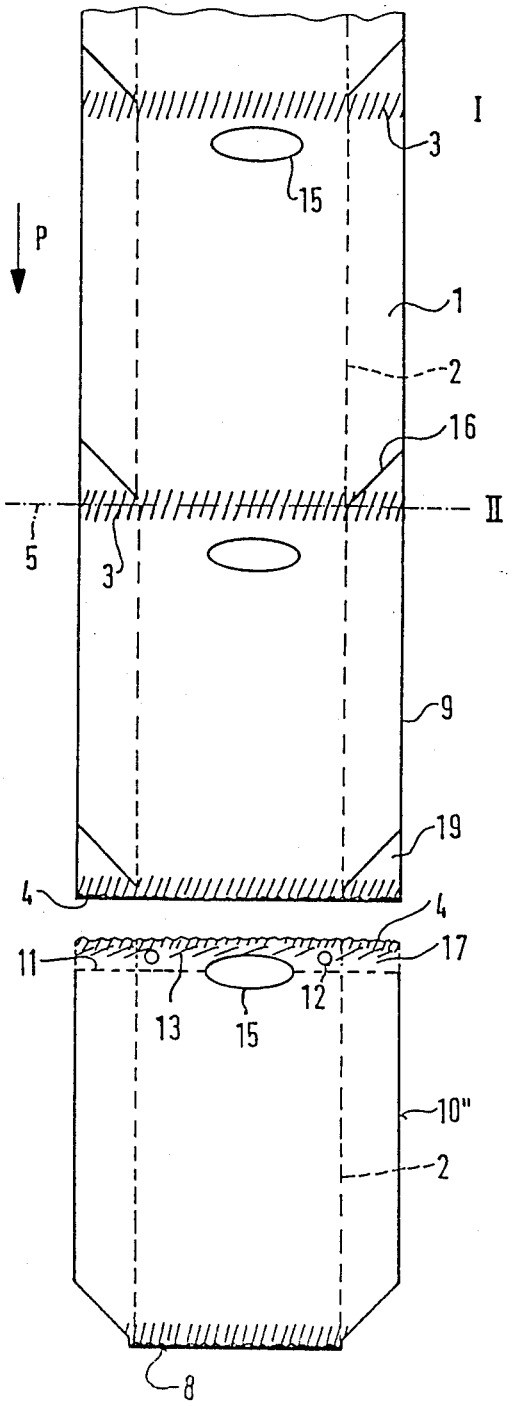
Fig.7
Fig.8
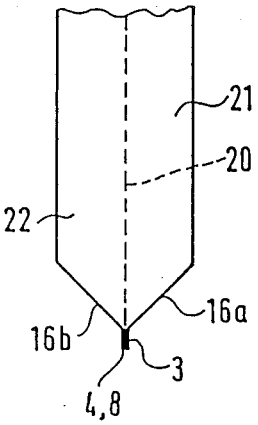
Fig.9

BAGS MADE FROM THERMOPLASTIC SYNTHETIC RESIN SHEETING HAVING CUTOFF WELD SEAMS AND PROCESS FOR PRODUCING THE BAGS

This invention relates to the production of bags from thermoplastic synthetic resin sheeting with a bottom seam and/or lateral seam fashioned as a cutoff weld seam, which are severed by transverse cutoff weld seams from tubular film sheets optionally provided with lateral creases, and which are optionally equipped, in the bottom zone, with obliquely extending corner weld seams arranged separately from each other in the two crease portions of the lateral creases.

The welding together of thermoplastic synthetic resin sheets takes place without the addition of foreign materials in the seam site by melting of the welded material in the seam site. Heating and cooling of the seam under pressure is desirable in order to achieve in this way a homogeneous seam having a smooth appearance and without exhibiting shrinkage, within a minimum time period. During thermal contact welding, the heat is transmitted by a constantly heated electrode; heat application can take place unilaterally or bilaterally. By means of the heat contact welding step, flush weld seams are produced in correspondence with the shape of the welding bar (electrode). In this procedure, the seam is not cooled off under pressure and thus it displays a more or less wavy appearance in correspondence with the varying types of sheet material.

In the so-called cutoff seam welding by means of welding blade, hot strip or hot wire, the application of heat is likewise effected unilaterally, and the welding material is severed into two parts, and simultaneously two weld seams are created on both sides of the parting line. The flush weld seam by means of contact welding and/or the cutoff weld seam by means of cutoff welding are the two most customary weld seams utilized in the manufacture of bags, shopping bags, or the like from synthetic resin films. Also a combined thermal contact-flush and -cutoff seam is possible. In this case, a constantly heated wire or hot strip is located in parallel to a welding bar[1] . While the welding bar produces the flush seam, the wire or the hot strip merely effects a cutting step. It is possible, for example, to arrange a hot wire between two welding bars so that two flush seams are produced and are severed simultaneously therebetween by means of hot wire.

[1] to act simultaneously with the welding bar beneath the welded seam to severe the welded seam from the unwelded material. The cutting step is made beneath the welded parts.

A process for the production of plastic shopping bags either with transverse weld seams and transverse severing cuts or transverse cutoff weld seams which are separated or cut off by welding from tubular film sheets of synthetic resin sheeting provided with lateral creases has been known, for example, from DOS 3,530,070.

The basic possibilities of producing weld seams in case of synthetic resin shopping bags, packaging bags, garbage bags, or the like are dealt with, for example, in the book "Kunststoffmaschinenfuehrer" (Guide to Plastics-Producing Machinery), Schaab/Stoeckhert, Karl Hansa Publishers, Munich/Vienna, 1979, in the chapter "Welding".

The invention is based on the object of increasing the strength and tear resistance of the bottom seams of shopping bags, carry bags, or the like, made of synthetic resin sheeting, which bottom seams are formed as cutoff weld seams, and thus improving the load-bearing ability, i.e., the load that can be carried. Furthermore, the leak-proofness of the bottom seam is enhanced, for example, against the efflux of liquids. Also, the upright standing ability in the opened condition for filling purposes is improved.

According to the invention, this object has been attained, in a process by providing that a wide flush weld seam is produced by heat contact welding, at a station upstream of a station for effecting a transverse seam cutoff welding of the bottom seam or lateral seam, over the entire width of the tubular film sheet and/or over the entire width of the bag bottom to be produced, and subsequently the transverse cutoff weld seam is formed over the flush weld seam, extending within the latter. [2] The second seam is dividing the first welding seam.

[2] The two welding seams are made succeedingly preferably the second after cooling and solidifying of the first one. The first welding seam should have a width of at least 1 mm, preferably 2 to 6 mm. The second made welding seam shall be a small welding and cutting seam, which is placed in the middle of the first seam in case of a side seam or near the rim of a bottom seam.

In accordance with the process of this invention, the cutoff seam is reinforced by the additional flush weld seam, i.e., the zone where the cutoff seam is provided is reinforced by a preliminary welding step. In this way, although a somewhat greater amount of material (film) is consumed for the weld seam, the result thereof is also the desired increase in strength and tearing-out resistance and thus in the load-bearing ability of the thus-produced bag. In particular, it is possible by means of this invention to reinforce, without additional use of material, seams at the shopping bags even if the film is merely laid in two plies one on top of the other. The width of the flush seam designed as preliminary weld and reinforcement depends on the existing conditions; this width should be at least about 1 mm, preferably 2 to 6 mm.

The formation of a reinforced cutoff weld seam as provided by this invention by the successive production of a flush seam and of a cutoff seam extended on the flush seam and guided along the flush seam, replaces and improves the procedure known heretofore for the manufacture of bottom weld seams in the shape of individual or double flush seams created by contact welding, with simultaneous separation therebehind and, respectively, therebetween. The reinformed welded cutoff seams produced in accordance with this invention, especially in the form of bottom weld cutoff seams for shopping bags, packaging bags, or the like of synthetic resin film, in place of flush seams produced by contact welding exhibit the further advantage that the film does not shrink in the zone of the cutoff seam, and does not leave any protruding part, either, whereby such bags, for example, can also be stood upright more readily, which affords advantages during filling. The process of this invention can also be performed advantageously in case of shopping bags having lateral seams, in order to reinforce same and thus to obtain a bag of high mechanical load-bearing capacity.

The process according to this invention can be utilized with special advantage for the manufacture of bags having reinforced, welded cutoff seams for tubular film webs of sheeting made from LLDPE (linear low density polyethylene), in order to avoid herein flush seams with cutoff separation. During the cutting of LLDPE films, a high wear is exerted on cutting tools since these become blunt very rapidly and frequent tool change is required. This problem is obviated in the process according to this invention of producing reinforced welded cutoff seams.

Customarily, the films for bags or the like have a thickness of about 15 μm to about 75 μm.

A further preferred field of application for the invention resides in bags and shopping bags of thick-walled synthetic resin sheeting, preferably of a thickness of about 25 to 120 μm. Thick-walled sheets impart to the bags a high strength, attainable previously, however, for the bottom weld seams only by the formation of very broad flush seams by means of heat contact welding by the individual seam method. Here again, the invention makes it possible to form a cutoff seam having a high strength over the entire width of the bottom of the bag. The cutoff seam of this invention, reinforced and welded, is distinguished by the formation of a thicker weld seam having a higher strength and a clean appearance since there is no flush.

The flush seams and the cutoff seams can be produced also for the process of this invention by means of the conventional technique. Areas of application are, in particular, here generally products called bags of films of thermoplastic synthetic resin, such as shopping bags, packaging bags, or the like, with or without handle hole, with or without handle hole reinforcing leaf, with or without lateral creases, with or without corner weld seams, with or without interlocking, with or without hanging holes, loosely stacked, with straight load-bearing rim, with sinusoidal load-bearing rim, as T-shirt design shopping bags, and so forth. The process of this invention is utilized, in particular, for the production of the bottom seams of the bags. These bags involve preferably bags equipped with a standing bottom formed by lateral creases and transverse corner welds, manufactured with preference from relatively stiff plastic sheeting permitting an upright positioning of the bags. The bottom seam, designed to be reinforced in the form of a cutoff weld seam makes it possible to readily set the bags upright since there is no interfering protrusion in the seam zone on the outside.

Embodiments of the invention will be described in greater detail hereinafter with reference to the accompanying drawings wherein:

FIG. 7 is a fragmentary top view of a tubular sheet for manufacturing bags with lateral pleats;

FIG. 8 is a plan view of an interlocked pack of bags with lateral pleats according to FIG. 7;

FIG. 9 is a side fragmentary view of the bag according to FIG. 8; and

Figure 1:
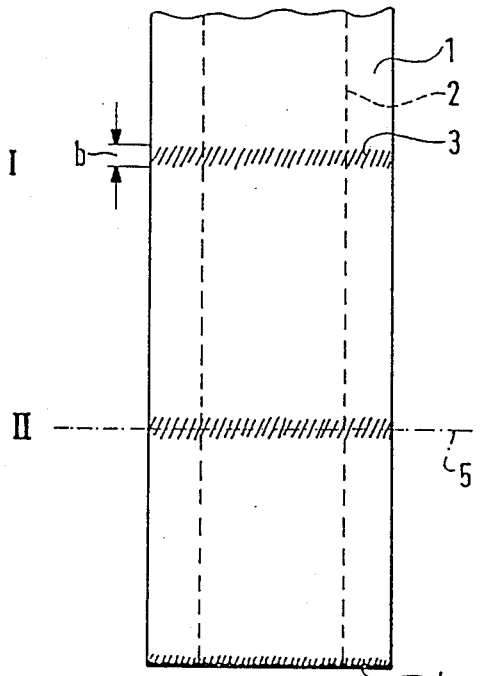
FIG. 1 is a schematic partial top view in connection with manufacturing the bags from a tubular sheet.
Figure 3:
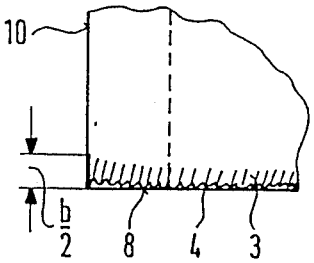
FIG. 3 is a fragmentary plan view of a bag with bottom cutoff weld seam.
Figure 2:
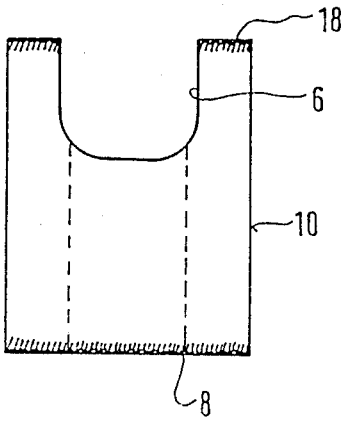
FIG. 2 shows a plan view of a shirt-design shopping bag.

T-shirt design shopping bags 10, as illustrated in FIG. 2, can be produced from a tubular sheet 1 shown in FIG. 1, for example. The tubular sheet 1, provided with lateral pleats 2, is transported in the direction of arrow P, thus being fed in succession into the welding stations I, II. In welding station I, the flush seam 3 is welded with a width b in the zone of the subsequent bottom cutoff seam over the entire breadth of the tubular sheet 1. In this arrangement, for example, a welding unit is provided having an upper movable welding bar and a lower fixed backup die, the latter being covered during standstill of the machine by means of a cooled cover sheet automatically so that the sheet, lying at rest on top thereof, will not be plasticized by the heat emanating from the lower welding bar and thus cannot be torn off when the sheet feed is started up again. Then the tubular sheet 1 is further transported by at least one bag length and passes, with the already welded flush seam 3, into the second welding station II equipped with a cutoff welding device. Here, a cutoff weld seam is welded, for example, centrally through the flush seam 3, as indicated by the center line 5, and the still closed, cut-off rough bag 10*a* with the cutoff seams 4 is passed on to the subsequent processing station. From the rough bag 10*a*, it is possible, for example, to produce, by punching, the T-shirt design bag 10 according to FIG. 2 with the cutout 6. The T-shirt or vest-like bags 10 can then be loosely collected into packs. The bag 10 according to FIG. 2 exhibits herein the bag bottom seam 8 formed from the welded cutoff seam 4 as well as from approximately half the width of the initially welded flush seam 3. Also, the load-bearing rim 18 is formed by the cutoff seam 4 reinforced by the other half of the initially welded flush seam 3. Thus, the bag 10 of FIG. 2 exhibits a very high load-bearing capacity and stress resistance which can be enhanced, for example, by choosing an appropriate material for the tubular film sheet 1. FIG. 3 shows schematically, in a fragmentary view, how the weld seams of the bag 10 are formed at the bottom seam 8 by overlapping of the cutoff weld seam 4 with the flush seam 3.

Figure 4:
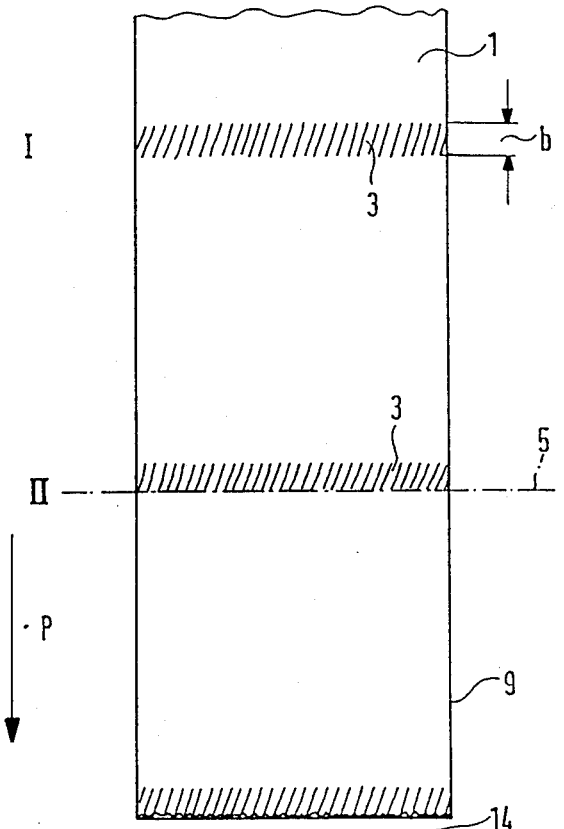
FIG. 4 is a fragmentary top view in connection with the manufacture of a shopping bag from a tubular sheet.
Figure 5:
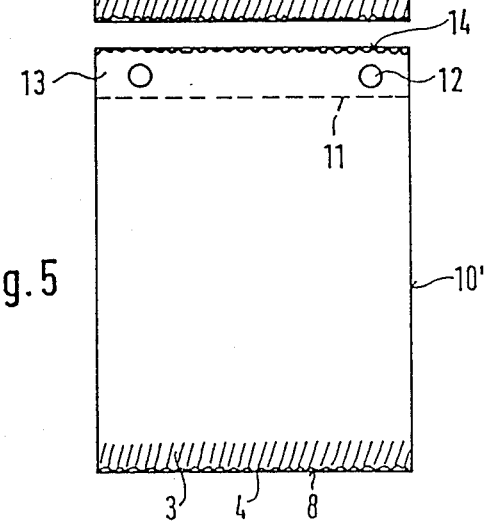
FIG. 5 shows a plan view of an interlocked pack of bags.

FIG. 4 shows schematically the progression of the process concerning the welding of the bottom of the bag, in order to manufacture a tear-off bag 10' of an interlocked pack according to FIG. 5. Here again, a tube sheet 1, which can be formed with or without side pleats, is provided with the flush seam 3 in welding station I by transverse welding over the entire width of the tubular sheet 1, in the width b. The breadth of the tubular sheets here also corresponds to the breadth of the bag.

Figure 6:
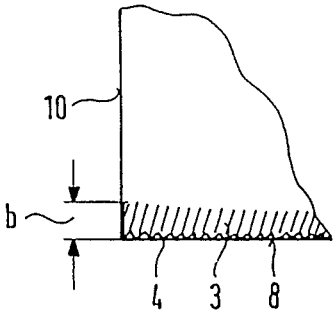
FIG. 6 is a fragmentary plan view of a bag with a bottom cutoff weld seam.

In the subsequent welding station II, the cutoff weld seam is created. This cutoff seam welding step can either sever the flush seam 3 approximately symmetrically as illustrated in FIG. 1, or it is also possible alternatively, depending on the structure and design of the bag 10 to be produced, to displace the cutoff seam 4 to a marginal zone of the flush seam 3, as indicated by the center line 5 according to FIG. 4. The cut-off rough bags 9 according to FIG. 4 can be collected into stacks, for example, in subsequent treatment steps not shown in detail and blocked together during this procedure in the marginal strips 13 for packaging, and then the tear-off perforation 11 can be punched for the separable marginal strip 13 and the hanging holes 12, in the stack. Then the bags 10' can be torn off individually along the tear-off perforation from the interlocked pack. On account of the asymmetrical correlation of the cutoff weld seam 4 to the initially welded flush seam 3, the bag 10' is designed with a very thick bottom weld seam 8 which thus exhibits a high strength, whereas factually only the cutoff seam 4 is formed at the top edge 14. The provision of the bottom weld seam of the bag 10', as shown in FIG. 5, is illustrated in a partial enlarged view in FIG. 6, according to which a bottom weld seam 8 practically encompasses the entire width b of the flush seam 3, as well as the welded cutoff seam 4.

FIGS. 7 to 9 show, in fragmentary schematic views, the production of a bag 10" with a flat bottom made of the tubular sheet 1 with inserted side pleats 2. The tubular sheet 1 according to FIG. 7 is, moreover, provided additionally with a unilateral punched-out hole 15 in the zone of the subsequent top load-bearing rim, and with corner weld seams 16 extending, starting with the outer edges of the side pleats, in a diverging fashion obliquely in the direction toward the subsequent bottom weld seam and terminate into the inner side pleat edge, ending in front thereof; see also FIG. 9. The tubular sheet 1, transported cyclically in the direction of arrow P, is then provided in welding station I with the transversely welded flush seam 3 extending over the entire width of the tubular sheet; the flush seam 3 adjoins the corner weld seams terminating at the inner side pleat edge or, advantageously, overlaps these corner weld seams somewhat. In the subsequent welding station II, by means of cutoff welding, the cutoff seam 4 is produced along the center line 5 on top of the flush seam 3. The severed rough bag 9 can then be finished to form an interlocked pack in subsequent stations, not shown, such pack being illustrated in FIGS. 8 to 13. The corners 19 below the corner weld seams 16 are removed by punching. In the zone of the grasping hole 15, the stacked bags 10 can be interlocked (see, for example, the bag according to FIGS. 11 and 13 with interlocking zone 13). The interlocking zone 13 can be fashioned as spot-like interconnection (see FIGS. 11 and 13), or as a two-dimensional interlocking area (see FIG. 8), over the entire width of the bag, or over part of the width thereof. In the interlocking zone 13, the hanging holes 12 and the tear-off perforation 11 are furthermore punched out along the perforated edge 15 and, respectively, over the width of the bag. It is likewise possible to form the tear-off perforation 11 at an earlier stage, i.e., prior to welding the bottom seam, optionally also prior to welding the corner weld seams. This also holds true for the hanging holes 12 and the punching of the handle hole 7. If desired, the shopping bag can be provided, by a shaping punching step, with a special configuration in the manner of a sinusoidal rim, and the upwardly projecting section 17 can be punched away either with a linear load-bearing rim edge 18 or also with a load-bearing rim of another shape; see FIGS. 12 and 13. By grasping the handle hole 15, the shopping bag 10 still adhering to the interlocked pack can be seized, opened, and pulled off at the tear-off perforation 11. The bottom seam 8 of the bag consists of the welded cutoff seam 4 reinforced by the broad flush seam 3 and thus also preventing tearing-out at the corners where the corner weld seams of the lateral pleats effect an accumulation of material. By the formation of the cutoff seam 4 at the bottom of the bag, a protrusion is moreover avoided and the setting up of the bag with the flat bottom is not impeded by protruding edges of sheeting, as is the case with flush seams produced by contact welding.

FIG. 9 shows in a schematic side view the formation of the two corner weld seams 16*a*, 16*b* in the two lateral pleat sections 21, 22, converging on the inner lateral pleat edge 20 at the bag bottom with the flush seam 3 and the cutoff seam.

Figure 10:
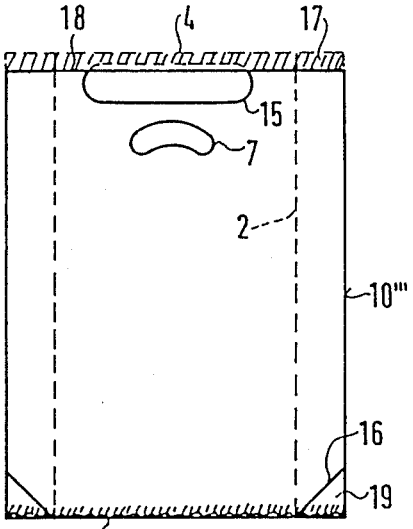
FIGS. 10–13 show versions of the bag structure according to FIGS. 7 and 8, respectively.

FIGS. 10 to 13 show additional advantageous embodiments of bags 10 with a reinforced cutoff weld seam as the bottom seam 8. Starting with the manufacturing scheme according to FIG. 7, the bag 10''' of FIG. 10 additionally exhibits a grasping hole 7 passing through both bag walls below the engagement hole 15. The bags according to FIG. 10 are loose, i.e., with no interlocking, and are provided, without a tear-off perforation, with a straight load-bearing rim 18 which latter is formed by punching out the strip-shaped section 17 with the cutoff weld seam 4.

Figure 11:
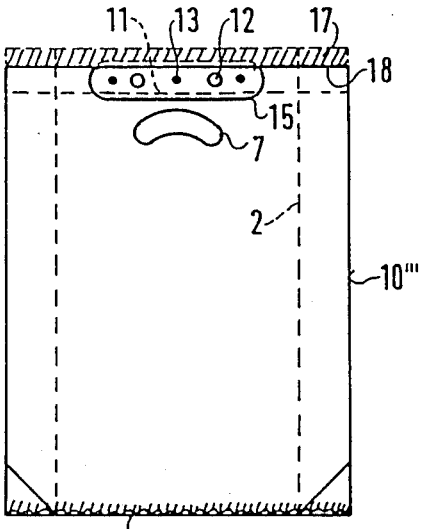
Figure 12:
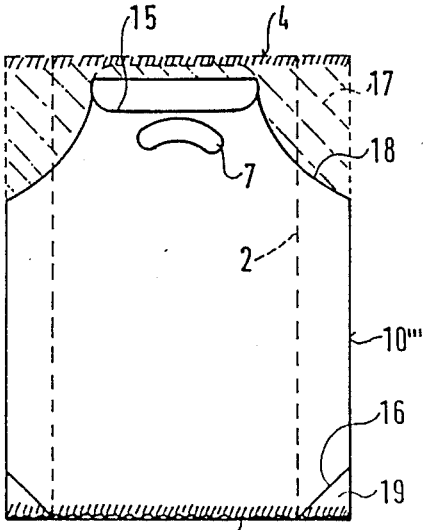
Figure 13:
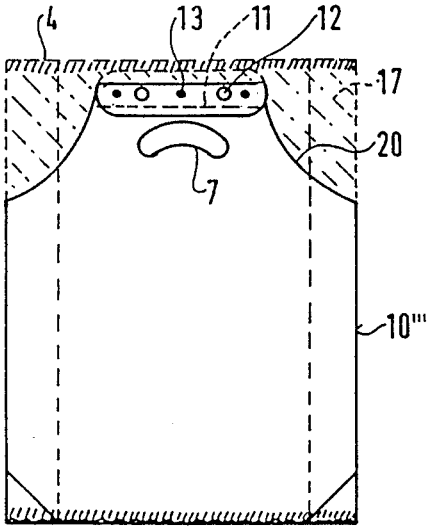

The bag 10''' according to FIG. 12 differs from the bag 10''' according to FIG. 10 by a differently shaped, approximately sinusoidal load-bearing rim 18 produced by correspondingly punching away an upper marginal section 17. In this procedure, in each case the connecting hole 15 on the front wall of the bag is included in section 17 in such a way that ready grasping and opening of the bag at the front wall is made possible. The bags 10''' according to FIGS. 11 and 13 represent further developments of the bags according to FIGS. 10 and 12 with respectively one interlocking section 13, tear-off perforation 11, and hanging holes 12 in the zone of the engaging hole 15 on the rear wall of the bag. The corner sections 19 can be cut off.

The subject matter of the present invention resides, inter alia, in the products manufactured by the process, as illustrated, inter alia, in the drawings.

I claim:

1. A process for the production of bags from thermoplastic synthetic resin sheeting with a transverse bottom seam fashioned as a cutoff weld seam, which bags are severed by transverse cutoff weld seams from tubular film sheets provided with lateral creases, and which are equipped, in a bottom zone, with obliquely extending corner weld seams arranged separately from each other in two crease portions of the lateral creases, characterized in that a transverse wide flush weld seam is produced by heat contact welding, at a station upstream of a transverse seam cutoff welding of the transverse bottom seam, over the entire width of the tubular film sheet and subsequently a transverse cutoff weld seam is formed within the flush weld seam at another station by heat contact welding and simultaneously severing the flush weld seam.

2. A process according to claim 1, characterized in that the flush seam is fashioned with a width of at least about 1 mm.

3. A process according to claim 1, characterized by using tubular sheets produced from films of polyethylene.

4. A process according to claim 1, 2 or 3, characterized by using tubular sheets from films having a thickness of about 15–120 μm.

5. A process according to claim 4, characterized by using tubular sheets from films having a thickness of about 15 m to about 75 μm.

6. A process for the continuous production of bags with at least a transverse bottom seam sealed by welding from a tubular sheet made of thermoplastic synthetic resin film, which comprises producing a wide flush weld seam by heat contact welding extending transverse over the entire width of the tubular film sheet, cooling and solidifying the wide flush weld seam, and subsequently forming a transverse cutoff weld seam within the flush weld seam by heat contact welding with simultaneous severing of the flush weld seam.

7. A process according to claim 6, wherein the flush weld seam has a width of from about 1 mm to 6 mm.

8. A process according to claim 6, wherein the tubular thermoplastic synthetic resin film sheet is comprised of at least one film layer of polyethylene.

9. A process according to claim 6, 7 or 8, wherein the tubular film sheet is obtained from a film having a thickness of about 15 to 120 μm.

10. A process according to claim 9, wherein said tubular film sheet is provided with lateral creases.

11. A process for the production of bags, each having a bag bottom with a transverse bottom seam formed by a cutoff weld seam from a thermoplastic tubular film sheet which comprises producing a wide flush weld seam by heat contact welding over the entire width of the tubular film sheet and over the entire width of the bag bottom to be produced at one welding station; transporting the tubular film sheet to another welding station; and subsequently forming a transverse cutoff weld seam within the flush weld seam at said another welding station by heat contact welding with simultaneous severing of the flush weld seam.

12. A process according to claim 11, wherein the wide flush weld seam has a width of at least about 1 mm.

13. A process according to claim 11, wherein the tubular film sheet comprises polyethylene or at least one layer of polyethylene.

14. A process according to claim 11, wherein the tubular film sheet is obtained from a film having a thickness of from about 15 to 120 μm.

15. A process according to claim 11, wherein said transverse cutoff weld seam is formed centrally through the wide flush weld seam.

16. A process according to claim 11, wherein the transverse cutoff weld seam is formed along an edge of the flush weld seam.

17. A process according to claim 11, further comprising providing a tubular film sheet provided with lateral creases and forming obliquely extending corner weld seams arranged separately from each other in two creased portions of the lateral creases in a bottom zone of the bag to be produced.

18. A process according to claim 11, wherein the tubular film sheet after formation of the wide flush weld seam is transported by at least one length of a bag to be produced to the another welding station.

* * * * *